US006820775B2

(12) United States Patent
Meike et al.

(10) Patent No.: US 6,820,775 B2
(45) Date of Patent: Nov. 23, 2004

(54) GAS-PRESSURIZED BEVERAGE KEG

(75) Inventors: Klaus Meike, Wilnsdorf-Rinsdorf (DE); Hans Helmut Reichmann, Burbach (DE)

(73) Assignee: Schafer Werke GmbH, Neunkirchen (DE)

( * ) Notice: Subject to any disclaimer, the term of this patent is extended or adjusted under 35 U.S.C. 154(b) by 48 days.

(21) Appl. No.: 10/244,033

(22) Filed: Sep. 13, 2002

(65) Prior Publication Data

US 2003/0062383 A1 Apr. 3, 2003

(30) Foreign Application Priority Data

Sep. 14, 2001 (DE) ..... 201 15 158 U

(51) Int. Cl.[7] ..... B67D 5/042
(52) U.S. Cl. ..... 222/386.5; 222/397; 222/400.7
(58) Field of Search ..... 222/130, 386.5, 222/396, 397, 400.7, 143, 95, 399

(56) References Cited

U.S. PATENT DOCUMENTS 1,885,678 A * 11/1932 Boyer ..... 222/396
3,024,800 A * 3/1962 Lewis ..... 137/209
3,158,296 A * 11/1964 Cornelius ..... 222/386.5
3,559,849 A * 2/1971 Ancel ..... 222/143
4,573,603 A * 3/1986 Starling et al. ..... 220/605
4,921,135 A * 5/1990 Pleet ..... 222/82
5,246,140 A 9/1993 Thix
5,957,328 A * 9/1999 Osgar ..... 222/1
6,015,068 A * 1/2000 Osgar et al. ..... 222/400.7
6,662,963 B1 * 12/2003 Meike et al. ..... 220/634

FOREIGN PATENT DOCUMENTS

DE 3737977 A1 * 11/1987 ..... B65D/8/04

* cited by examiner

*Primary Examiner*—Gene Mancene
*Assistant Examiner*—Melvin A. Cartagena
(74) *Attorney, Agent, or Firm*—Herbert Dubno; Andrew Wilford

(57) ABSTRACT

A beverage container has a cylindrical lower side wall and floor defining a lower beverage chamber and centered on an axis, a cylindrical upper side wall and upper wall centered on the axis and defining an upper pressurized-gas chamber, and an annular partition having an outer edge welded to an upper edge of the lower side wall and a lower edge of the upper side wall and a center part closely juxtaposed with the upper wall of the upper chamber. A tap assembly mounted on the upper-chamber upper wall has a riser tube projecting through the partition center part into a lower region of the lower chamber. An upper protective ring is fitted to the upper part and to the valve assembly and a lower protective ring is fitted to the lower part. The rings and side walls have the same diameters.

9 Claims, 1 Drawing Sheet

GAS-PRESSURIZED BEVERAGE KEG

FIELD OF THE INVENTION

The present invention relates to beverage container. More particularly this invention concerns gas-pressurized beverage keg.

BACKGROUND OF THE INVENTION

A standard beer keg has a gas chamber and a beverage chamber. A tap assembly includes a gas valve that allows the gas chamber to be pressurized with a gas, normally nitrogen for wine and carbon dioxide for beer or soda, and has a pressure regulator that passes the gas at a uniform pressure to the beverage chamber where it forms a gas head. A riser tube is connected through the tap assembly to a tap valve and extends down to a lower region of the beverage chamber so that when the tap valve is open the gas head pushes the beverage up the riser tube and out a spout of the tap valve. Such containers are normally called kegs and are of cylindrical shape, with the chambers made of metal and plastic rings provided at upper and lower ends to facilitate handling and stacking. They come in various sizes, having beverage chambers of 65 l to 20 l capacity and gas chambers of 6 l to 30 l size.

U.S. Pat. No. 5,246,140 of Thix describes such a container where the gas chamber is defined as an annular tube fitted to an upper region of the keg, or as a plurality of vertical tubes extending down in or around the keg. The gas valve sets an internal pressure of e.g. 0.8 bar for wine when using nitrogen and 2.1 bar for beer when using carbon dioxide. The construction of this keg is quite complex and in most models it is surrounded by a thick plastic jacket in which the gas chambers are imbedded. Thus the keg is bulky and, because of the plastic jacket, is hard to cool.

Another keg sold by Alumasc GB has a large capacity of 40 l. to 50 l of liquid in a stout aluminum container. It has two identical parts welded centrally together with a rounded outer shape having horizontal outwardly projecting stiffening ribs. The combination of the shape of this keg plus the fact that only the bottom half holds liquid means that it is difficult to extract heat from it and cool its contents. In addition it is relatively difficult to handle, ship, and store, as when on its side it rolls.

OBJECTS OF THE INVENTION

It is therefore an object of the present invention to provide an improved beverage container.

Another object is the provision of such an improved beverage container which overcomes the above-given disadvantages, that is which is of simple construction, yet which is easy to chill, handle, and stack.

SUMMARY OF THE INVENTION

A beverage container has according to the invention a substantially cylindrical lower side wall and floor defining a lower beverage chamber and centered on an axis, a substantially cylindrical upper side wall and upper wall centered on the axis and defining an upper pressurized-gas chamber axially aligned above the lower chamber, and an annular partition having an outer edge welded to an upper edge of the lower side wall and a lower edge of the upper side wall and a center part closely juxtaposed with the upper wall of the upper chamber. The partition downwardly closes the upper chamber and upwardly closes the lower chamber. A tap assembly mounted on the upper-chamber upper wall has a riser tube projecting through the partition center part into a lower region of the lower chamber. An upper protective ring is fitted to the upper part and to the valve assembly and a lower protective ring is fitted to the lower part. The rings and side walls having generally the same diameters.

Such a container or keg can be used with different types of beverages and is inexpensive to manufacture. It can be stored, transported, and handled easily. Cooling the contained beverage is easy as a large surface of metallic wall is internally in direct contact with the beverage and externally exposed, so extracting heat from the beverage through the wall is simple and efficient. The annular gas chamber is particularly easy to construct and can hold substantial pressure. Only a single circular weld connects the three main parts—the upwardly open cup of the lower beverage chamber, the downwardly open cup of the gas chamber, and the downwardly cupped partition—so that the keg can be assembled cheaply with minimal possibility of leakage. The cylindrical shape allows a standard cylindrical cooler or jacket to be fitted over the keg for quick cooling of its contents.

According to the invention the tap assembly includes a gas valve fixed to the upper-chamber upper wall, a tap valve projecting radially past the upper ring, and a pressure regulator connected between the gas valve and the tap valve. The upper ring has a seat in which the tap valve fits and is formed with a radially inwardly open seat in which the gas valve fits. The radially inwardly open seat is formed by a pair of radially inwardly directed and axially extending ridges. In addition the upper wall and floor are formed with pressure-blowoff burst formations. The tap head is mounted on the keg by the user of the keg, often someone only slightly familiar with how to do this. The upper-ring seat insures that the head will be mounted in the right orientation and connected up properly, as it will not fit in any other position. Thus even the clumsiest user will be sure to get the tap working properly. The head type is determined by the beverage being dispensed; the same keg can be used for instance for soda or beer pressurized with $CO_2$ or wine pressurized at a different pressure with $N_2$.

To facilitate stacking and storage of the keg, the lower ring is formed with four radially outwardly projecting corners imparting to it a generally square footprint. These corners insure that the kegs will all be aligned when packed together, and prevent the kegs from rolling if on their side. Furthermore carrying the keg on a hand truck, as is common, is particularly easy as in effect there are four flats on the lower protective ring. The corners have outer edges rounded to a radius equal to between 20% and 35% of a diameter of the side walls. In addition formations align the corners of the lower ring such that the tap assembly projects from the upper ring equidistant between two of the corners. The lower ring is formed with a seat dimensioned to receive an upper edge of an upper ring of another such keg.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
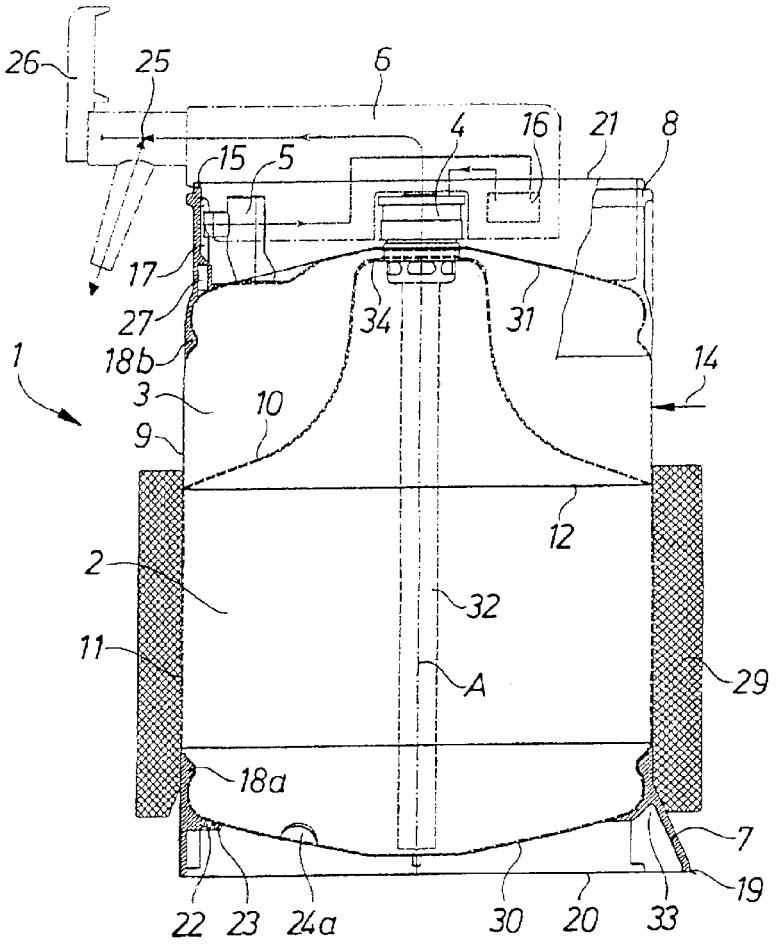
FIG. 1 is a partly diagrammatic vertical section through the keg according to the invention.
Figure 2:
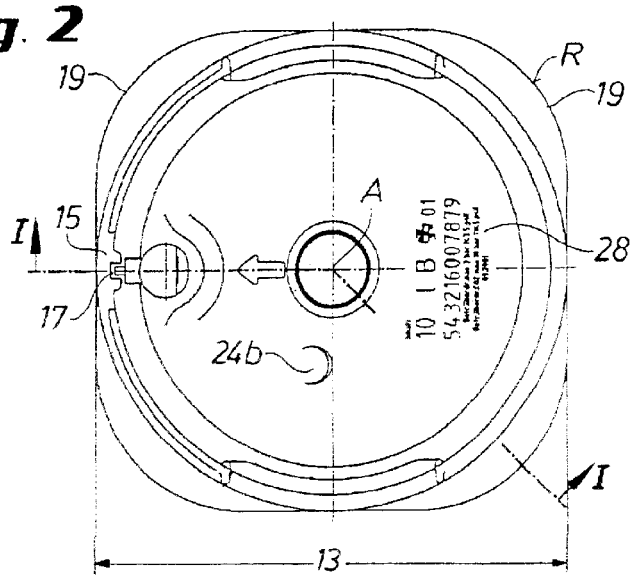
FIG. 2 is a top view of the keg, line I—I of FIG. 2 illustrating the section plane of FIG. 1.

As seen in FIGS. 1 and 2, a beer keg 1 according to the invention has a lower beer chamber 2 defined by a tall cylindrical side wall 11 and an upwardly concave floor 30 and an upper gas chamber 3 having a short cylindrical side wall 9 and a downwardly concave upper wall 31. An annular partition 10 forms an upper wall of the lower chamber 2 and a floor of the upper chamber 3. This partition wall 10 has a center part 34 closely juxtaposed with the upper-chamber upper wall 31, is joined at a circular weld 12 to an upper edge of the lower side wall 11 and to a lower edge of the upper side wall 9, and is downwardly cup-shaped so that the upper chamber 3 is annular. The walls 9, 10, 11, 30, and 31 are all centered on an upright axis A. The lower wall 30 and the upper wall 31 are formed with safety-blowoff formations 24*a* and 24*b* that are weakened and intended to rupture if the respective chambers 1 and 2 are overpressurized. The upper wall 31 carries indicia 28 identifying the size of the container, its pressure ratings, and so on.

A riser tube 32 extends along the axis A and has a lower end immediately above a lowest point of the floor 30 and an upper end seated in a valve assembly 4 of a head 6 also holding an integrated pressure regulator 16 and a gas valve 5. This valve 5 serves for pressurization of the upper chamber 3 and is mounted on the wall 31. It has an outlet connected via the regulator 16 with the valve assembly 4. A tap valve 25 of the head 6 has a lever 26 that is actuated to dispense the liquid stored in the chamber 2 as is well known in the art.

According to the invention a plastic one-piece foot ring 7 is mounted on a lower end of the keg 1 and a similar ring 8 is carried on its upper end. The upper ring 8 and its lower gripper rim 18*b* have a diameter 13 that is no greater and here in fact equal to a diameter 14 of the walls 9 and 11. The lower ring 7 is similarly dimensioned with a gripper rim 18*a* seated in a radially outwardly open groove of the wall 11, but has corner extensions 19 giving it a basically rounded-corner square shape with a side length equal to the diameter 13. The corners 19 are rounded to a radius R equal to between 20% and 35% of the diameter 13. Thus these corners 19 ensure that the kegs 1 can be set closely to one another with the heads 6 parallel. In addition they prevent the keg 1 from rolling if it is on its side.

The floor 30 has a formation, here a bump 22, received in another complementary formation, here a recess or seat 23, aligned underneath the valve 5 to ensure that the tap 25 projects from a flat side of the squarish shape of the keg's footprint. In addition the upper ring 8 is formed with a pair of ribs 17 defining a groove in which the valve 5 fits and with an upwardly open notch or seat 15 in which the tap 25 fits, so everything is always aligned. A circular upper edge 21 of the upper ring 8 fits complementarily in a circular lower seat 33 of the lower ring 7 so that the kegs 1 according to the invention can be stacked and will be stable when stacked. The upper ring 8 is fitted with a transponder 27 that can be read without contact for inventory purposes.

A cooling collar or jacket 29 with a high heat capacity can be fitted around the lower chamber 2 to cool liquid therein. It is cylindrical and a snug fit, that is has an inside diameter equal to slightly more than the diameter 13, so that there is good heat transfer through the metallic wall 11 between the stored liquid and the cooling jacket 29.

We claim:

1. A beverage container comprising:

a substantially cylindrical lower side wall and floor defining a lower beverage chamber and centered on an axis;

a substantially cylindrical upper side wall and upper wall centered on the axis and defining an upper pressurized-gas chamber axially aligned above the lower chamber;

an annular partition having an outer edge welded to an upper edge of the lower side wall and a lower edge of the upper side wall and a center part closely juxtaposed with the upper wall of the upper chamber, the partition downwardly closing the upper chamber and upwardly closing the lower chamber;

a tap assembly mounted on the upper-chamber upper wall and having a riser tube projecting through the partition center part into a lower region of the lower chamber, a gas valve fixed to the upper-chamber upper wall, and a tap valve protecting radially past the upper ring; and a pressure regulator connected between the gas valve and the tap valve;

an upper protective ring fitted to the upper part and formed with a seat fitted to the tap valve; and a lower protective ring fitted to the lower part, the rings and side walls having generally the same diameters.

2. The beverage container defined in claim 1 wherein the upper wall and floor are formed with pressure-blowoff burst formations.

3. The beverage container defined in claim 1 wherein the lower ring is formed with a seat dimensioned to receive an upper edge of an upper ring of another such keg.

4. A beverage container comprising:

a substantially cylindrical lower side wall and floor defining a lower beverage chamber and centered on an axis;

a substantially cylindrical upper side wall and upper wall centered on the axis and defining an upper pressurized-gas chamber axially aligned above the lower chamber;

an annular partition having an outer edge welded to an upper edge of the lower side wall and a lower edge of the upper side wall and a center part closely juxtaposed with the upper wall of the upper chamber, the partition downwardly closing the upper chamber and upwardly closing the lower chamber;

a tap assembly mounted on the upper-chamber upper wall and having a riser tube projecting through the partition center part into a lower region of the lower chamber;

an upper protective ring fitted to the upper part and to the tap assembly; and a lower protective ring fitted to the lower part, the rings and side walls having generally the same diameters, the upper ring is formed with a radially inwardly open seat in which the gas valve fits.

5. The beverage container defined in claim 4 wherein the radially inwardly open seat is formed by a pair of radially inwardly directed and axially extending ridges.

6. A beverage container comprising:

a substantially cylindrical lower side wall and floor defining a lower beverage chaniber and centered on an axis;

a substantially cylindrical upper side wall and upper wall centered on the axis and defining an upper pressurized-gas chamber axially aligned above the lower chamber;

an annular partition having an outer edge welded to an upper edge of the lower side wall and a lower edge of the upper side wall and a center part closely juxtaposed with the upper wall of the upper chamber, the partition downwardly closing the upper chamber and upwardly closing the lower chamber;

a tap assembly mounted on the upper-chamber upper wall and having a riser tube projecting through the vartition center part into a lower region of the lower chamber;

an upper protective ring fitted to the upper part and to the tap assembly; and a lower protective ring fitted to the lower part, the rings and side walls having generally the same diameters, the lower ring being formed with four radially outwardly projecting corners imparting to it a generally square footprint.

7. The beverage container defined in claim 6 wherein the corners have outer edges rounded to a radius equal to between 20% and 35% of a diameter of the side walls.

8. The beverage container defined in claim 6, further comprising formations aligning the corners of the lower ring such that the tap assembly projects from the upper ring equidistant between two of the corners.

9. A beverage container comprising:

a substantially cylindrical lower side wall and floor defining a lower beverage chamber and centered on an axis;

a substantially cylindrical upper side wall and upper wall centered on the axis and defining an upper pressurized-gas chamber axially aligned above the lower chamber;

respective burst formations on the floor and upper-chamber upper wall;

an annular partition having an outer edge welded to an upper edge of the lower side wall and a lower edge of the upper side wall and a center part closely juxtaposed with the upper wall of the upper chamber, the partition downwardly closing the upper chamber and upwardly closing the lower chamber;

a tap assembly mounted on the upper-chamber upper wall and having a riser tube projecting through the partition center part into a lower region of the lower chamber, a tap valve projecting radially outward, a gas valve fixed to the upper wall and communicating therethrough with the upper chamber, and a pressure distributor connected to the tap valve and gas valve;

an upper protective ring fitted to the upper part and having seats holding the tap valve and gas valve; and a lower protective ring fitted to the lower part, the rings and side walls having generally the same diameters.

* * * * *